United States Patent [19]

Endo et al.

[11] 4,398,386

[45] Aug. 16, 1983

[54] PROCESS AND APPARATUS FOR SIMULTANEOUSLY DRAWING AND FALSE-TWISTING THERMOPLASTIC SYNTHETIC YARN

[75] Inventors: Tetsuhiko Endo, Kyoto; Kunihiko Ueda; Tadashi Kohara, both of Ohtsu, all of Japan

[73] Assignee: Toray Industries, Inc., Tokyo, Japan

[21] Appl. No.: 255,854

[22] Filed: Apr. 20, 1981

[30] Foreign Application Priority Data

Apr. 23, 1980 [JP] Japan ..... 55-54791

[51] Int. Cl.[3] ..... D02G 1/02; D02G 1/16

[52] U.S. Cl. ..... 57/288; 57/282; 57/290

[58] Field of Search ..... 57/282, 284, 287, 288, 57/290, 291, 308

[56] References Cited

U.S. PATENT DOCUMENTS

| | | | |
|---|---|---|---|
| 3,910,027 | 10/1975 | Bach et al. | 57/290 X |
| 4,120,141 | 10/1978 | Lopatin et al. | 57/288 |
| 4,164,116 | 8/1979 | Kimura et al. | 57/282 |

*Primary Examiner*—Donald Watkins

*Attorney, Agent, or Firm*—Armstrong, Nikaido, Marmelstein and Kubovcik

[57] ABSTRACT

A process and an apparatus for simultaneously drawing and false-twisting a thermoplastic synthetic yarn, in or by which an undrawn or a partially drawn yarn is drawn under a dry hot condition in a condition of the yarn being false-twisted by twist transmitted from a false-twister and immediately thereafter heat-set under a wet hot condition prior to untwisting.

The apparatus includes a yarn heater, which comprises a dry heater disposed on the side of a feeding device for the undrawn or partially drawn yarn and a wet heater on the side of a false-twister along the yarn passing direction.

13 Claims, 13 Drawing Figures

FIG. 3
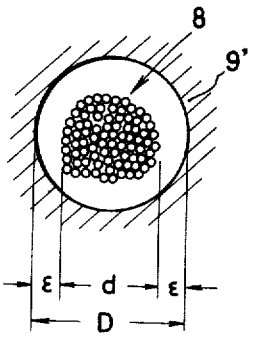
FIG. 4
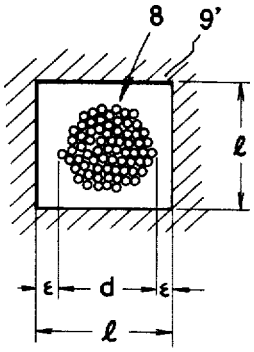
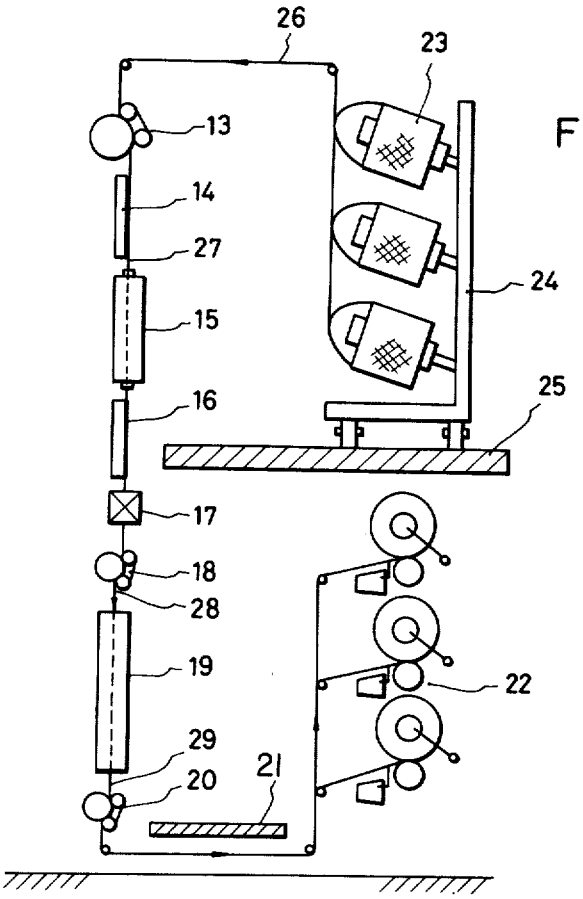
FIG. 5

FIG. 11
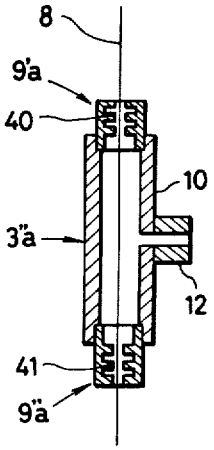
FIG. 12
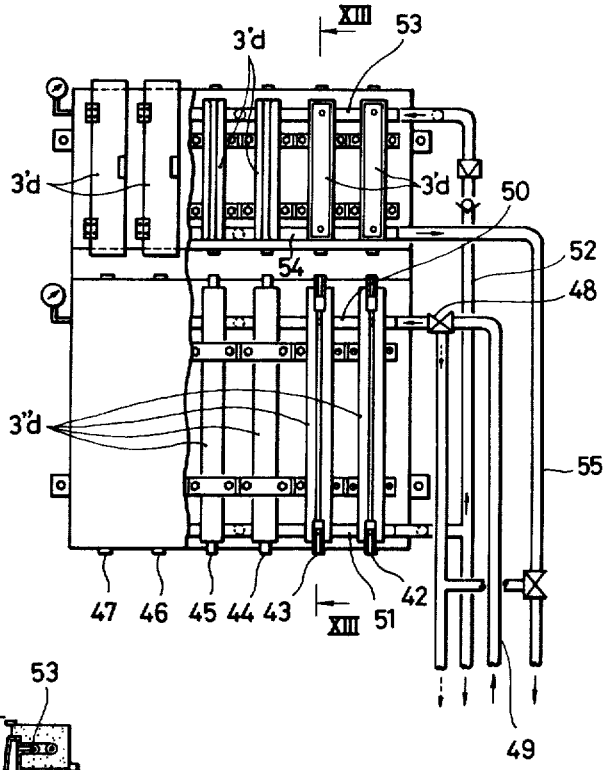
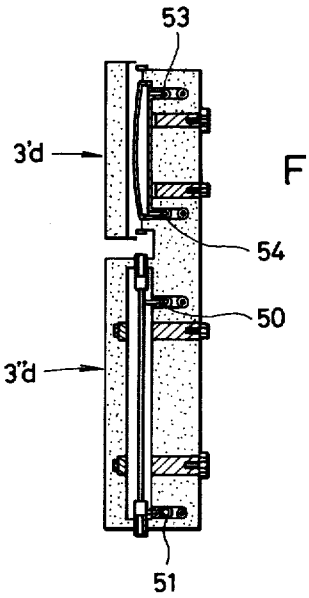
FIG. 13

PROCESS AND APPARATUS FOR SIMULTANEOUSLY DRAWING AND FALSE-TWISTING THERMOPLASTIC SYNTHETIC YARN

BACKGROUND OF THE INVENTION

The present invention relates to a simultaneous drawing and false-twisting process and apparatus and, more particularly, to a drawing and false-twisting process and apparatus capable of heating yarn sufficiently in a short distance and also avoiding a substantial increase leakage external leak of steam from a heater and a reduction of mechanical strength of a product textured yarn.

Hitherto, it is known to use a dry heating device such as a heating plate as a heating means in a high-speed false twisting process. The current increasing of the processing speed, however, requires an impractical length of the heating region. It is also known to thermally set the yarn while imposing a false twisting by passing the yarn through a heating device. According to this method, it is necessary to use steam of a high temperature and pressure, particularly when the yarn is made of polyester fibers requiring a high setting temperature. The result is a difficulty in the construction of the sealing mechanism in the wet heating device.

It is also known to effect a false twisting simultaneously with a drawing by treating an undrawn or partially drawn yarn by a drawing and false-twisting apparatus. However, since the undrawn or partially drawn yarn has a large diameter, it is necessary to make the yarn passage at the yarn inlet section of the wet heat-setting device to have a sufficiently large diameter, resulting in an increased leak of the steam to the outside. In addition, since the yarn is brought into contact with steam of high temperature before sufficient orientation and crystallization, the yarn tends to be crystallized excessively causing a reduction of the strength of the textured yarn and permitting a generation of nap.

BRIEF SUMMARY OF THE INVENTION

Accordingly, it is an object of the present invention to provide a simultaneous drawing and false-twisting process and apparatus capable of heating thermoplastic synthetic yarns sufficiently in a short distance.

Another object of the present invention is to provide a simultaneous drawing and false-twisting process and apparatus in which the drawing and false-twisting of yarn, particularly undrawn or partially drawn yarn, can be performed simultaneously without being accompanied by a substantial increase in the external leakage of steam and a reduction of mechanical strength, thereby to overcome the above-described problems of the prior art.

To this end, according to the present invention there is provided a process for simultaneously drawing and false-twisting a thermoplastic synthetic yarn which comprises drawing under a dry hot condition an undrawn or partially drawn yarn substantially in a condition of being false-twisted by twist transmitted from a false twister, and immediately thereafter heat-setting the yarn under a wet hot condition prior to untwisting of the yarn. Further, there is provided apparatus for operating the process, which comprises a yarn feeding device, a yarn heating device, a yarn false-twisting device and a yarn take-up device arranged in this order along the yarn passing direction. In this apparatus, the yarn heating device comprises a dry heating element disposed on the side of the yarn feeding device and a wet heating element disposed on the side of the false-twisting device.

BRIEF DESCRIPTION OF THE DRAWINGS

FIGS. 3 and 4 are sectional views of yarn inlet section of different wet heaters, respectively;

FIGS. 5 and 6 illustrate a further embodiment of the present invention, respectively;

FIG. 11 is a sectional view of a still another embodiment of the wet heater;

FIG. 12 is a front view, partly in section, of a further embodiment of the yarn heater assembly; and FIG. 13 is a sectional view of the yarn heater assembly, taken along the line XIII—XIII of FIG. 12.

DETAILED DESCRIPTION OF THE PREFERRED EMBODIMENTS

Figure 1:
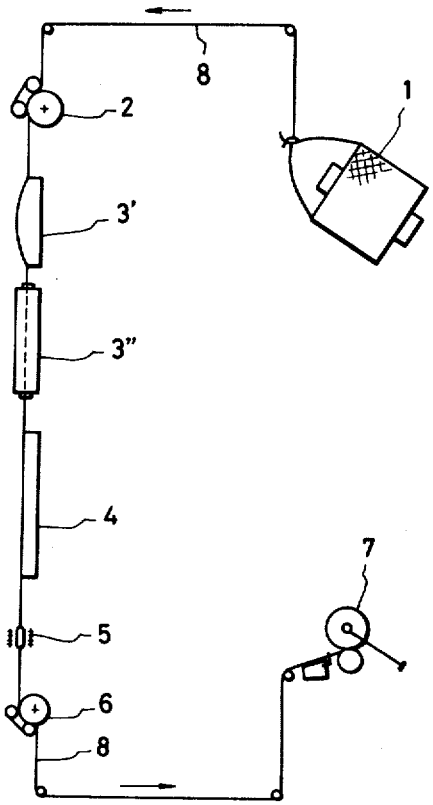
FIG. 1 is an illustration of an embodiment of the present invention.

In the apparatus shown in FIG. 1, a yarn let-off package 1, a yarn feeding roller 2, a dry heater 3' for dry heating treatment of the yarn, a wet heater 3'' for wet heating treatment of the yarn, a cooler 4 for cooling treatment of the yarn, a false-twister 5, a yarn taking-up roller 6 and a winder 7 are arranged in series in this order in the direction of running of the yarn 8. The dry heater 3' and the wet heater 3'' are arranged in series to and in close proximity to each other and, in addition, between the yarn feeding roller 2 and cooler 4. The dry heater 3' is adapted to heat up the yarn 8 to a drawing temperature which is usually selected from not lower than the second transition temperature of the yarn to the melting point temperature of the yarn and the wet heater 3'' is adapted to thermally set the yarn 8 after heating by the dry heater 3'.

Figure 7:
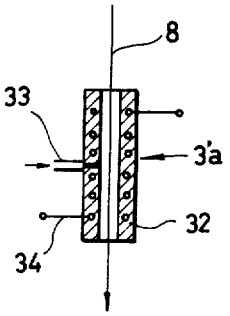
FIG. 7 is a sectional view of one embodiment of the dry heater.

The dry heater 3' should have a length sufficiently large to heat the undrawn or partially drawn yarn under a false twisted condition at the drawing temperature. This length normally falls between 10 cm and 100 cm. The most effective structure of the dry heater 3' incorporates a heating plate to which the yarn is brought to contact as shown in FIG. 1. For dry heating treatment of the yarn, a hot air atmosphere which is formed by supplying heated air or by heating with infrared radiation may be employed as the dry heater 3', for example a dry heater **3'*a* as shown in FIG. 7. The dry heater 3'*a* comprises a tubular member 32 having a hot air supplying pipe 33 and an electrical heating device 34 to form a hot air atmosphere inside of the tubular member 32 through which the yarn 8 is passed. Instead of supplying externally hot air, it may be devised to form a hot air atmosphere solely by heating the tubular member 32 with the electrical heating device 34**.

The heating plate itself may be heated by various known heating means such as electric resistance wire, or heating medium confined in a closed vessel and heated electrically. It is also possible to heat the reverse side of the heating plate by making use of a part of the steam of high pressure and temperature supplied to the wet heater 3''.

Figure 8:
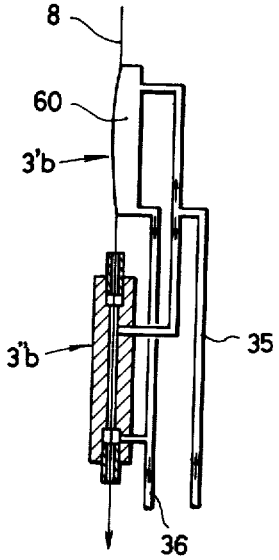
FIGS. 8 and 9 are sectional views of different embodiments of a yarn heater assembly.
Figure 9:
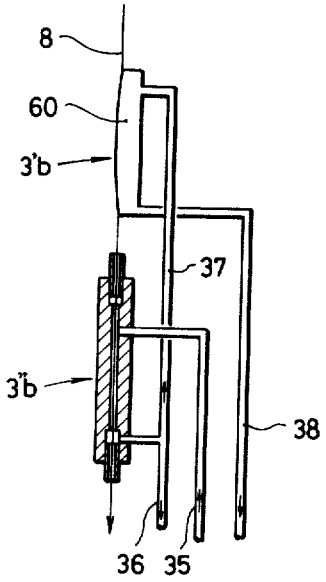

FIGS. 8 and 9 each shows another type dry heater 3'b heated with a steam supplied into a jacket 60 behind a yarn contact surface of the dry heater 3'b. In FIG. 8, steam is simultaneously supplied in parallel into dry and wet heaters 3'b and 3''b through a steam pipe 35. Condensate or steam is taken out through a pipe 36. In FIG. 9, steam is supplied into a wet heater 3''b firstly by the pipe 35, and then supplied from the wet heater 3''b to a dry heater 3'b. Condensate or steam is taken out through pipes 36 and 38 respectively. In FIG. 9, it is possible that the pipe 38 can be used for supplying steam and the pipe 35 is used for taking out condensate or steam.

Figure 10:
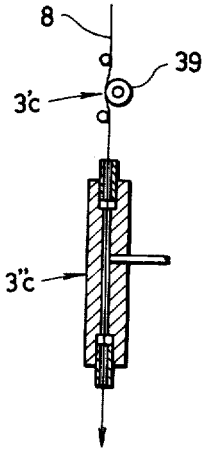
FIG. 10 is a sectional view of another embodiment of the yarn heater assembly.

FIG. 10 shows a still another type of dry heater 3'c which comprises a rod 39 heated by electrical energy or a heated liquid at the inside of the rod 39.

All that is necessary is to heat up the yarn to the drawing temperature without bringing the yarn into direct contact with the steam of high pressure and temperature.

Figure 2:
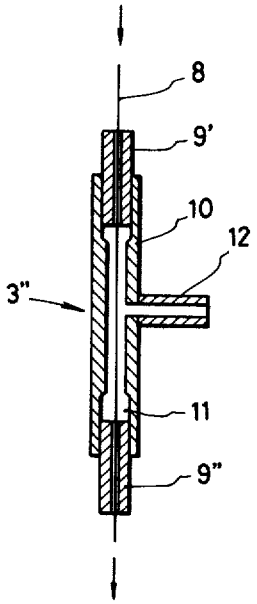
FIG. 2 is a sectional view of a wet heating device.

FIG. 2 schematically shows an example of the wet heater 3''. The yarn 8 false-twisted after being heated up to the drawing temperature is sent to a heat treating section 10 of a tubular body through a sealing device 9', and is heat-treated by a steam which is blown into the section 10 through a steam inlet 12. The yarn is then extracted from the wet heater 3'' through a sealing device 9'' and is introduced to the cooler 4. Saturated or superheated water vapour is used as the heating steam.

The sealing devices 9' and 9'' have openings for permitting the yarn 8 to run therethrough. These openings can have various shapes such as circular, oval, semi-circular or the like. It is, however, necessary to reduce the cross-sectional area of this opening as much as possible without hindering the passage of the yarn, in order to minimize the leakage of steam.

Each of the sealing devices 9' and 9'' shown in FIG. 2 employs a single nozzle. In order to further enhance the sealing effect, however, as shown in FIG. 11 it is possible to arrange a plurality of nozzles 40 or 41 in series at a suitable predetermined distance. This type of a sealing device 9'a and 9''a is generally known as a labyrinth seal. In this case, it is possible to connect the outermost chamber of the labyrinth seal to a vacuum source as in the case of the arrangement shown in Japanese Patent Publication No. 33688/74. Alternatively, as shown in Japanese Utility Model Publication No. 42206/75, the inner chamber of the labyrinth seal may be connected to the vacuum source while the outermost chamber is supplied with compressed air.

The cooler 4 comprises a metal plate acting as a radiator. If necessary, the plate may have one or more fins thereon to make radiation of the heat more fluently.

The apparatus of the invention having the described construction offers the following advantages.

The yarn 8 is heated by the dry heater 3' up to the drawing temperature and is drawn while being false-twisted. This yarn 8 after completion of the drawing is then introduced into the wet heater 3''. Therefore, the yarn has, when it passes through the inlet sealing device 9' of the wet heater 3'', a uniform and small area in cross-section to advantageously reduce the resistance encountered during passing through the sealing device 9' to avoid any damage of the yarn. In addition, since the propagation of the twist is never hindered, it is possible to effect a twisting operation at a high density with reduced twisting torque. In addition, since the yarn has been drawn and stabilized in the internal structure thereof when it passes through the portion 10 of the wet heater 3'' where it is subjected to the steam of high pressure and temperature, the undesirable excessive crystallization is avoided conveniently.

It will be readily understood also from FIGS. 3 and 4 that the leakage of steam can be diminished by reducing the cross-sectional area of the yarn passing through the sealing device 9'. More specifically, FIG. 3 schematically shows a false-twisted yarn of a diameter d passing through a sealing device 9' having a diameter D. In order to ensure a smooth passage of the yarn, it is necessary to preserve a clearance $\epsilon$ between the yarn and the wall of the passage. From FIG. 3, it will be seen that there is a relationship expressed by $D=d+2\epsilon$ between the diameters D and d. The steam tends to leak out through the clearance $\epsilon$. Assuming that other conditions are identical, the rate of the leak is proportional to the clearance area $S_L$ which can simply be expressed as follows:

Namely, the following relationship is derived from the condition shown in FIG. 3:

$$S_L = \frac{\pi}{4} D^2 - \frac{\pi}{4} d^2 = \frac{\pi}{4} (d + 2\epsilon)^2 - \frac{\pi}{4} d^2$$

$$= \frac{\pi}{4} [4d\epsilon + 4\epsilon^2] = \pi\epsilon(d + \epsilon)$$

On the other hand, the same consideration applies also to the case where the yarn passage of the sealing device 9' has a square cross-section having four sides of a length l as shown in FIG. 4.

$$S_L = l^2 - \frac{\pi}{4} d^2 = (d + 2\epsilon)^2 - \frac{\pi}{4} d^2$$

$$= \left(1 - \frac{\pi}{4}\right) d^2 + 4\, d\epsilon + 4\epsilon^2$$

In addition, since there is a relation expressed by $1-\pi/4>0$, the $S_L$ is given as an increment function of d and $\epsilon$ in each case of FIGS. 3 and 4.

Namely, when the clearance $\epsilon$ is constant, the clearance area $S_L$, and accordingly the amount of steam leakage is reduced as the yarn diameter d is reduced. It is considered also from this point of view that it is effective to reduce the yarn diameter by the completion of drawing before the yarn enters the sealing device of the wet heater, in order to diminish the leakage of steam.

One of other embodiments of the simultaneous drawing and false-twisting apparatus of the invention will be described hereinunder with specific reference to FIGS. 5 and 6.

Referring to FIG. 5, reference numerals 13, 14, 15 and 16 denote, respectively, a yarn feeding roller, a dry heater consisting of a heating plate, a wet heater and a yarn cooler. Numerals 17, 18 and 19 respectively denote a false twister, a yarn feeding roller and a heating tube as a reheat-setter of a yarn. A yarn feeding roller, a working bed and a yarn winder are designated at reference numerals 20, 21 and 22, respectively. A plurality of yarn let-off packages 23 are suspended on a creel truck 24 disposed on a mezzanine floor 25. The starting material yarn 26 is made to pass the devices and parts mentioned above in the mentioned sequence as indicated by an arrow. Thus, a drawn yarn under a false-twisted condition is obtained at 27, a false-twisted textured yarn is obtained at 28 and finally a reheat-treated textured yarn is obtained at 29. In the production of so-called stretch yarn requiring no reheat-setting, the false-twisted textured yarn 28 may be directly wound on the yarn winder 22, without being passed through the yarn reheat-setter 19.

In the described embodiment, the dry heater, wet heater, yarn cooler and yarn reheat-setter have lengths of 0.5 m, 0.8 m, 0.6 m and 1.2 m, respectively.

Figure 6:
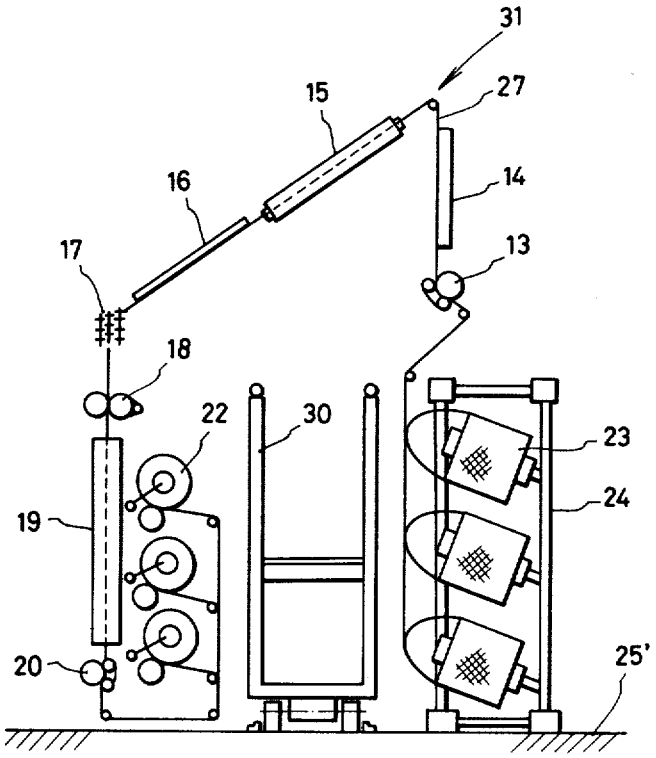

FIG. 6 shows another embodiment which is constituted by a yarn feeding roller 13, a dry heater 14, a wet heater 15, a yarn cooler 16, a false-twister 17, a yarn feeding roller 18, a yarn reheat-setter 19, a yarn feeding roller 20 and a yarn winder 22.

In contrast to the embodiment shown in FIG. 5, the creel 24 for suspending the yarn let-off packages 23 is fixed on a ground floor 25'. In addition, a working truck 30 is disposed to be movable along the longitudinal direction of the apparatus, between the yarn winder 22 and the creel 24 to facilitate the above-described operation.

The feature of this embodiment resides in that the drawn yarn 27 under a false-twisted condition is deflected by a guide 31 between the dry heater 14 and the wet heater 15 as illustrated. Although the propagation of the twist imparted by the false-twister 17 toward the dry heater 14 may be slightly hindered by the deflection, the twist is propagated linearly to the wet heater 15 through the yarn cooler 16, so that the finally heat-set yarn can have a high false-twisting density.

In this embodiment, the lengths of the dry heater, wet heater, yarn cooler and yarn reheat-setter are 0.6 m, 1.0 m, 1.0 m and 1.4 m, respectively.

In accordance with the embodiment under consideration, a sufficient heat-treatment is obtained even with the arrangement shown in FIG. 6, without a long heat treating length of 2.5 m consisting solely of the dry heater described in Reference 2 in the undermentioned Tables 1 and 2. In addition, remarkable effects of elimination of reduction in strength and increase of nap index, which tend to occur when the heating is effected solely by the wet heater, are achieved by the apparatus of this embodiment.

FIGS. 12 and 13 show a further embodiment of the dry heating device and the wet heating device, which is preferably used in practising the present invention for texturing two or more yarns simultaneously. FIG. 12 shows a front view of the embodiment and FIG. 13 shows a side view of the embodiment shown in FIG. 12. The embodiment has six yarn passages 42 through 47, and a dry heater **3'*d* and a wet heater 3''*d* are provided respectively on each of the six yarn passages 42 through 47. Saturated or superheated water vapour is fed to each wet heater 3''*d* through a common feeding pipe 50 which is connected to a main feeding pipe 49 via a regulating valve 48. A common taking-out pipe 51 is connected to each of wet heaters 3''*d*, and the vapour passing through each wet heater 3''*d* is fed to each dry heater 3'*d* through a pipe 52 connected to the pipe 51. A common feeding pipe 53 is connected to each of the dry heaters 3'*d*, and the vapour is introduced into each dry heater 3'*d* through the common feeding pipe 53. Steam or condensate coming out from each dry heater 3'*d* is gathered into a common taking-out pipe 54 which is connected to a main outlet pipe 55**.

This embodiment is characterized in that a plurality of the dry and wet heaters **3'*d* and 3''*d*** are arranged in one unit formation.

By beforehand completing the drawing in the false-twisted condition in the dry heater and then thermally setting the yarn in the wet heater, it is possible to obtain a superior effect of sufficient crimping characteristic and yarn strength, with a heat treating zone of a reduced length as a whole, as will be understood from the following description of Examples and References.

EXAMPLE 1

Material yarn: Partially drawn polyester yarn, 264 denier, 48 filaments
Texturing speed: 800 m/min after drawing
Drawing ratio: 1.827 times
Type of false-twister: Direct (friction) type false-twister
Number of false-twist: About 2300 T/m at the region immediately before false-twister Drawing and false twisting were conducted simultaneously by using the apparatus shown in FIG. 1 in accordance with various conditions as listed in Table 1 below and under a common condition specified above. Table 1 also shows other heat treating conditions by way of References.

From Table 2 also below recited, it will be seen that the conventional thermo-setting method employing only the dry heater cannot provide sufficient crimp contraction due to insufficient thermosetting, although sufficient strength and elongation are maintainted.

TABLE 1

| | | Construction of Heater | | | |
|---|---|---|---|---|---|
| | | Dry Heater | | Wet Heater | |
| Test No. | Overall Length of Heater (m) | Length (m) | Surface Temp. (°C.) | Length (m) | Steam Temp. (°C.) |
| Example 1 | 1.6 | 0.6 | 220 | 1.0 | 209 |
| Reference 1 | 1.5 | 1.5 | 220 | — | — |
| Reference 2 | 2.5 | 2.5 | 220 | — | — |
| Reference 3 | 1.0 | — | — | 1.0 | 209 |
| Reference 4 | 1.5 | — | — | 1.5 | 209 |

TABLE 2

| Level | Heat Treating Device | Strength | Elongation | Crimp Contraction | Nap Index |
|---|---|---|---|---|---|
| Example 1 | Dry 0.6 m Wet 1.0 m | 4.78 g/d | 25.6% | 31.5% | 0.5 |
| Reference 1 | Dry 1.5 m | 4.91 | 25.1 | 13.7 | 0.1 |
| Reference 2 | Dry 2.5 m | 5.28 | 25.5 | 24.2 | 0.1 |
| Reference 3 | Wet 1.0 m | 4.64 | 22.6 | 24.6 | 1.0 |
| Reference 4 | Wet 1.5 m | 4.47 | 17.4 | 25.6 | 1.0 |

Notes:
The crimp contraction value (C.C.) is calculated as follows:
$C.C. = [(L_2 - L_1)/L_2] \times 100$ $L_1$ is measured as follows: (1) Wind a hank of 20 wraps. One wrap length is 1.25 meter. (2) Put the hank in free for more than 24 hours. (3) Dry heat the hank in the oven at 150° C. for 5 minutes under the tension of 1.67 mg/denier. (4) Cool the hank for more than 24 hours at room temperature. (5) Measure the length of the hank under the above mentioned pre-load tension. The measured length is denoted as $L_1$.

$L_2$ is measured as follows: (1) Remove the pre-load. (2) Put the constant load of 0.1 g/denier instead. (3) Measure the length of the hank after 30 seconds under this tension. The measured length is denoted as $L_2$.

In Reference 2 in which the heat treating length is increased to 2.5 m, the crimp contraction is increased as compared with Reference 1 but is still unsatisfactory. In contrast, in Reference 3 in which the wet heating length solely is made over a length of 1.0 m, the crimp contraction is much larger than that of Reference 1, although the length of the heating zone is reduced to 1 m. The strength, however, is reduced undesirably and the nap index is high after the texturing. This is considered to be attributable to an excessive thermal crystallization caused by the heat treatment in which the partially drawn polyester yarn of insufficient crystal orientation before drawing was heat-treated directly with steam of high pressure and temperature.

In contrast to the above, in Example 1 according to the invention, the strength and elongation take satisfactory values approximating those of References 1 and 2. The nap index is also about a half of those of References 3 and 4, although it is somewhat greater than those of References 1 and 2. Furthermore, concerning the crimp contraction, the value obtained with Example 1 is apparently higher than that of Reference 2 employing the dry heater of 2.5 m in length and that of Reference 4 employing the wet heater of 1.5 m in length, although the arrangement of Example 1 employs a heating region length of 1.6 m in all which is rather short in a high-speed twisting apparatus. Thus, it was confirmed that the apparatus of the invention can produce textured yarn of high quality having a sufficiently high crimp recovery. This is because of the sequential combination of a simultaneous dry and wet heat-treatment in series in accordance with the present invention. Thus, the present invention offers a great industrial advantage when undrawn or partially drawn yarns are textured at a high speed.

What is claimed is:

1. A process for drawing and false-twisting a thermoplastic synthetic yarn comprising simultaneously drawing an undrawn or a partially drawn yarn under a dry hot condition while false-twisting the same, and immediately thereafter heat-setting the yarn under a wet hot condition in an atmosphere of saturated or superheated water vapor prior to untwisting of the yarn.

2. A process as recited in claim 1, wherein said dry hot condition is at a temperature of not lower than the second transition temperature of the thermoplastic synthetic yarn.

3. A process as recited in claim 1, further comprising reheat-setting subsequent to said untwisting.

4. A process as recited in claim 1, wherein said thermoplastic synthetic yarn is a polyester yarn.

5. An apparatus for simultaneously drawing and false twisting a thermoplastic synthetic yarn comprising in series in a yarn passing direction: a yarn feeding device, a first yarn heater comprising a dry heating element, a second yarn heater comprising a wet heating element providing an atmosphere of saturated or superheated water vapor, a yarn false-twisting device, and a yarn taking-up device.

6. Apparatus as recited in claim 5, which further comprises a yarn cooling device disposed between said second yarn heater and said false-twisting device.

7. Apparatus as recited in claim 5, wherein said dry heating element comprises a plate member contacting and heating the yarn.

8. Apparatus as recited in claim 5, wherein said dry heating element comprises a rod member contacting and heating the yarn.

9. Apparatus as recited in claim 5, which further comprises guide means disposed between said dry heating element and said wet heating element for deflecting the running direction of the yarn without substantially hindering the false-twisting of the yarn.

10. Apparatus as recited in claim 5, which further comprises a yarn reheat-setting device disposed between said false-twisting device and said yarn taking-up device.

11. An apparatus for simultaneously drawing and false-twisting two or more thermoplastic synthetic yarns comprising in series in a yarn passing direction on each of two or more yarn passages: a yarn feeding device, a first yarn heater comprising a dry heating element, a second yarn heater comprising a wet heating element providing an atmosphere of saturated or superheated water vapor, a yarn false-twisting device and a yarn taking-up device, said each of the wet heating elements being assembled adjacent each other and interconnected in one unitary set to receive said saturated or superheated water vapor through one regulating valve.

12. An apparatus for simultaneously drawing and false-twisting a thermoplastic synthetic yarn comprising in series in a yarn passing direction: a yarn feeding device, a first yarn heater comprising a dry-heating element which includes a plate member contacting and heating the yarn, a second yarn heater comprising a wet heating element providing an atmosphere of saturated or superheated water vapor, a yarn false twisting device, and a yarn taking-up device, said plate member being heated by hot water vapor through a jacket provided on the plate member, said dry heating element and said wet heating element being in communication with each other through a conducting pipe, said saturated or superheated water vapor introduced into said wet heating element being guided to said jacket through said conducting pipe.

13. An apparatus for simultaneously drawing and false-twisting a thermoplastic synthetic yarn comprising in series in a yarn passing direction: a yarn feeding device, a first yarn heater comprising a dry heating element which includes a plate member contacting and heating the yarn, a second yarn heater comprising a wet heating element providing an atmosphere of saturated or superheated water vapor, a yarn false twisting device, and a yarn taking-up device, said plate member being heated by hot water vapor through a jacket provided on the plate member, said dry heating element and said wet heating element being in communication with each other through a conducting pipe, said saturated or superheated water vapor introduced into said jacekt being guided to said wet heating element through said conducting pipe.

* * * * *